US011940231B2

(12) United States Patent
Zhang et al.

(10) Patent No.: US 11,940,231 B2
(45) Date of Patent: Mar. 26, 2024

(54) HEAT DISSIPATION DEVICE

(71) Applicant: Guangdong Envicool Technology Co., Ltd., Zhongshan (CN)

(72) Inventors: Jing Zhang, Zhongshan (CN); Genglin Ding, Zhongshan (CN)

(73) Assignee: GUANGDONG ENVICOOL TECHNOLOGY CO., LTD., Zhongshan (CN)

( * ) Notice: Subject to any disclaimer, the term of this patent is extended or adjusted under 35 U.S.C. 154(b) by 1 day.

(21) Appl. No.: 17/680,306

(22) Filed: Feb. 25, 2022

(65) Prior Publication Data

US 2022/0299274 A1 Sep. 22, 2022

(30) Foreign Application Priority Data

Mar. 18, 2021 (CN) ..... 202120561499.9

(51) Int. Cl.
*F28F 1/12* (2006.01)
*F28F 1/30* (2006.01)

(52) U.S. Cl.
CPC ..... *F28F 1/12* (2013.01)

(58) Field of Classification Search
CPC ..... F28F 1/12; F28F 1/30; F28D 15/0275; F28D 15/0283; F28D 15/06; F28D 15/0233
USPC ..... 165/80.4
See application file for complete search history.

(56) References Cited

U.S. PATENT DOCUMENTS 4,881,580 A * 11/1989 Murphy ..... F28D 15/0283 269/21
9,578,780 B1 * 2/2017 Shih ..... H01L 23/427
2004/0105235 A1 * 6/2004 Lai ..... F28F 1/32 361/700
2004/0173342 A1 * 9/2004 Sugito ..... F28D 15/0233 165/104.21
2005/0028965 A1 2/2005 Chen
(Continued)

FOREIGN PATENT DOCUMENTS

DE 102009057163 A1 6/2011

OTHER PUBLICATIONS

Extended European search report of EP application No. 22159508.5 dated Aug. 3, 2022.

*Primary Examiner* — Len Tran
*Assistant Examiner* — Gustavo A Hincapie Serna
(74) *Attorney, Agent, or Firm* — Andrew C. Cheng

(57) ABSTRACT

A heat dissipation device includes a heat absorbing member being provided with a first accommodating chamber for accommodating a working medium and a mounting hole in communication with the first accommodating chamber; and a valve installed in the mounting hole. The valve is adjustable between a first state and a second state to change the first accommodating chamber between a closed state and an open state. When the first accommodating chamber is in the open state, the first accommodating chamber is in fluid communication with outside so that the working medium can be injected into or discharged from the first accommodating chamber, so as to adjust the amount of the working medium in the first accommodating chamber. Thus, the heat dissipation device is applicable to various applications with different heat dissipating requirements.

18 Claims, 4 Drawing Sheets

(56) References Cited

U.S. PATENT DOCUMENTS

| | | | | |
|---|---|---|---|---|
| 2005/0173098 | A1* | 8/2005 | Connors | F28D 15/0233 165/104.21 |
| 2009/0120625 | A1* | 5/2009 | Janezich | F28F 9/10 165/173 |
| 2010/0263834 | A1* | 10/2010 | Hwang | F28D 15/0266 165/104.26 |
| 2012/0151938 | A1 | 6/2012 | Przybylski et al. | |
| 2016/0348985 | A1* | 12/2016 | Sun | F28D 15/04 |
| 2017/0102187 | A1 | 4/2017 | Anderl et al. | |
| 2017/0153066 | A1* | 6/2017 | Lin | F28D 15/046 |
| 2017/0227298 | A1* | 8/2017 | Sun | F28D 15/04 |
| 2017/0314870 | A1* | 11/2017 | Lin | F28F 3/08 |
| 2017/0343295 | A1* | 11/2017 | Lan | F28F 9/013 |
| 2017/0343297 | A1* | 11/2017 | Lan | F28D 15/0266 |
| 2017/0356694 | A1* | 12/2017 | Tan | F28D 15/0266 |
| 2018/0192545 | A1* | 7/2018 | Chen | H05K 7/20409 |
| 2019/0049190 | A1* | 2/2019 | Liu | F28F 1/325 |
| 2019/0128617 | A1* | 5/2019 | Mira | F28D 15/0275 |
| 2019/0264986 | A1* | 8/2019 | Chen | F28F 1/40 |
| 2020/0084917 | A1* | 3/2020 | Wei | H01L 23/427 |
| 2020/0315064 | A1* | 10/2020 | Agostini | F28D 15/0266 |
| 2020/0355441 | A1* | 11/2020 | Lin | B23P 15/26 |
| 2021/0104450 | A1* | 4/2021 | Zhong | F28D 15/0233 |
| 2021/0125898 | A1* | 4/2021 | Torresin | F28F 1/26 |
| 2021/0315130 | A1* | 10/2021 | Manninen | F28D 15/0233 |
| 2022/0018610 | A1* | 1/2022 | Chen | F28D 15/0233 |
| 2022/0018611 | A1* | 1/2022 | Chen | F28D 15/046 |
| 2022/0022339 | A1* | 1/2022 | Chen | F28D 15/0233 |
| 2022/0163267 | A1* | 5/2022 | Liu | F28F 3/06 |
| 2022/0319949 | A1* | 10/2022 | Pentikäinen | H01L 23/4006 |
| 2023/0184491 | A1* | 6/2023 | Wang | F28D 9/0062 165/166 |

* cited by examiner

HEAT DISSIPATION DEVICE

CROSS-REFERENCE TO RELATED APPLICATION

This application claims priority to Chinese patent application No. 2021205614999, filed on Mar. 18, 2021, the entire content of which are hereby incorporated by reference.

TECHNICAL FIELD

The disclosure relates to the technical field of heat dissipation, and in particular to a heat dissipation device.

BACKGROUND

For an existing sealed heat dissipation device, after it is produced, the amount of a phase change working medium inside it is fixed and cannot be changed. Therefore, the existing sealed heat dissipation device can only be applied to some applications of specific heat fluxes.

SUMMARY

In view of this, the disclosure provides a heat dissipation device in which the amount of a phase change working medium can be adjusted.

A heat dissipation device, including a heat absorbing member configured to absorb heat from a heat source, the heat absorbing member being provided with a first accommodating chamber for accommodating a phase change working medium and a mounting hole in communication with the first accommodating chamber; and a valve installed in the mounting hole of the heat absorbing member, the valve being adjustable between a first state and a second state to cause the first accommodating chamber to change between a closed state and an open state. When the first accommodating chamber is in the open state, the first accommodating chamber is in fluid communication with outside the first accommodating chamber so that the phase change working medium can be injected into or discharged from the first accommodating chamber.

In some embodiments, the heat dissipation device further comprises a heat dissipating member connected to the heat absorbing member.

In some embodiments, a passage in fluid communication with the first accommodating chamber is provided inside the heat dissipating member.

In some embodiments, an end of the heat dissipating member close to the first accommodating chamber is provided with a guide channel which is in fluid communication with the first accommodating chamber and the passage.

In some embodiments, the guide channel is wider than the passage.

In some embodiments, the heat dissipation device further comprises heat dissipating fins connected to the heat dissipating member.

In some embodiments, a cover plate is arranged at an end of the heat dissipating member away from the heat absorbing member, and the heat dissipating fins are stacked between the heat absorbing member and the cover plate.

In some embodiments, a passage in fluid communication with the first accommodating chamber is arranged inside the heat dissipating member, and a second accommodating chamber in fluid communication with the passage is formed inside the cover plate.

In some embodiments, a side of the cover plate facing the heat dissipating members is provided with positioning protrusions, and the heat dissipating member is correspondingly provided with positioning grooves for receiving the positioning protrusions respectively.

In some embodiments, two side plates are arranged on opposite sides of the heat absorbing member respectively, the heat dissipating member comprises multiple spaced heat dissipating elements arranged between and spaced from the two side plates, and the heat dissipating fins are respectively arranged between the heat dissipating elements or between one of the heat dissipating elements and a corresponding one of the side plates.

In some embodiments, each of the fins comprises a base plate and a pair of fixing plates extending from opposite side edges of the base plate, the fixing plates being secured to the heat dissipating elements or the side plates.

In some embodiments, the heat dissipating element has a plate-shaped configuration, the fixing plates are parallel to the heat dissipating elements, and the base plate is perpendicular to the fixing plates and the heat dissipating elements.

In some embodiments, the heat dissipating member is configured as a solid metal plate.

In some embodiments, when the first accommodating chamber is in the closed state, the first accommodating chamber is sealed and isolated from outside the first accommodating chamber.

In some embodiments, the valve is a plug which is detachably mounted in the mounting hole.

According to embodiments of the disclosure, the first accommodating chamber can be opened by the valve to allow the phase change working medium to be injected into or discharged from the first accommodating chamber, so as to adjust the amount of the phase change working medium in the first accommodating chamber. Therefore, the heat dissipation device is applicable to various applications with different heat fluxes and different heat dissipating requirements, and can achieve a good heat dissipation effect in various applications with different heat dissipating requirements.

Figure 1:
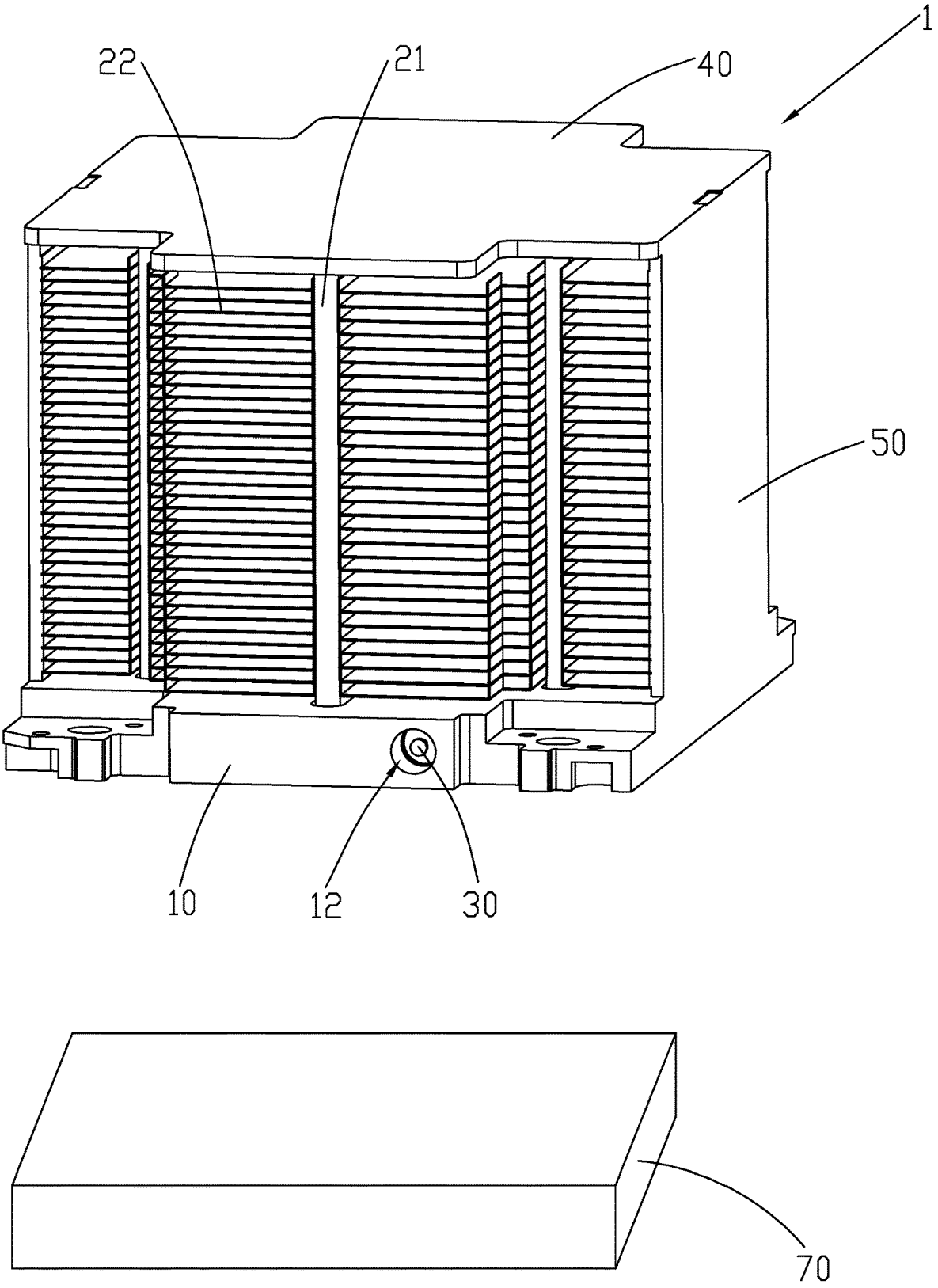
FIG. 1 is a schematic structural diagram of a heat dissipation device according to an embodiment of the disclosure.
Figure 2:
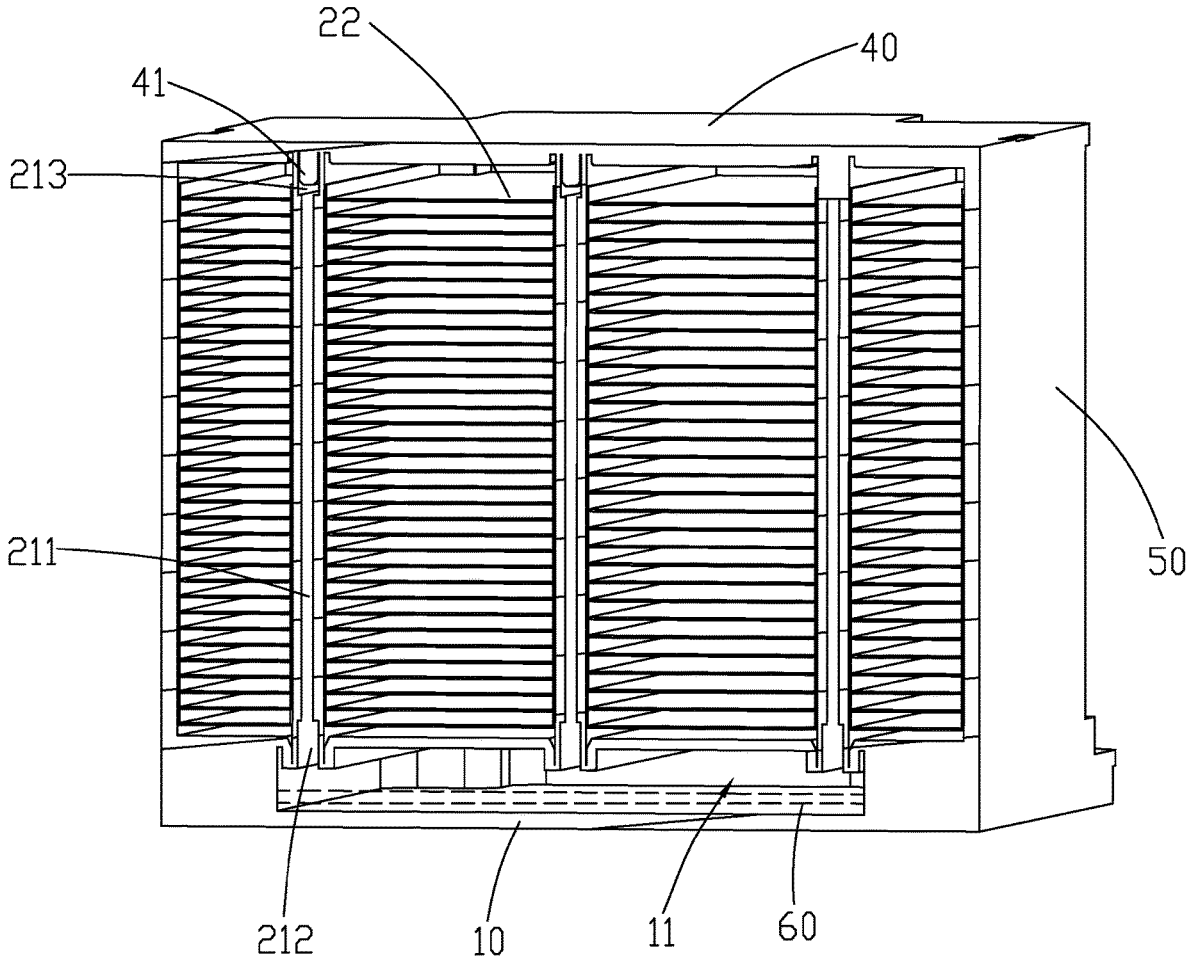
FIG. 2 is a schematic cross-sectional diagram of the heat dissipation device shown in FIG. 1.

In the figures: 1. heat dissipation device; 10. heat absorbing member; 21. heat dissipating member; 30. valve; 40. cover plate; 50. side plate; 11. first accommodating chamber; 12. mounting hole; 22. heat dissipating fin; 221. base plate; 222. fixed plate; 211. gas-liquid flow passage; 41. positioning protrusion; 212. guide channel; 213. positioning groove; 60. working medium; 70. heat source.

DESCRIPTION OF THE EMBODIMENTS

The disclosure will be further described below in conjunction with the drawings and specific implementations. It should be noted that, provided that there is no conflict, the following embodiments or technical features can be arbitrarily combined to form a new embodiment.

It should be noted that all directional indications (such as up, down, left, right, front, back, inside, outside, top, bottom . . . ) in the embodiments of the disclosure are only used to explain a relative position relationship between components in a certain specific attitude (as shown in the figures). If the specific attitude changes, the directional indications will also change accordingly.

It should also be noted that when an element is referred to as being "fixed on" or "arranged on" another element, the element may be directly fixed/arranged on the other element or there may be an intermediate element located therebetween. When an element is referred to as being "connected" to another element, it can be directly connected to the other element or there may be an intermediate element located therebetween.

Referring to FIGS. 1 to 4, a heat dissipation device 1 according to an embodiment of the disclosure includes a heat absorbing member 10 and a heat dissipating member 21 connected to the heat absorbing member 10. The heat absorbing member 10 and the heat dissipating member 21 are made of a material with good thermal conductivity. The heat absorbing member 10 is configured to be connected with a heat source 70 to absorb heat therefrom, thereby cooling the heat source 70. The heat dissipating member 21 is configured to absorb the heat of the heat absorbing member 10, and then exchange the heat with air around the heat dissipating member 21 to dissipate the heat to the surrounding air, so that the heat absorbing member 10 can absorb heat from the heat source 70 effectively.

In other embodiments, the heat dissipation device 1 may not include the heat dissipating member 21. That is, the heat dissipating member 21 may be omitted. After absorbing the heat from the heat source 70, the heat absorbing member 10 directly exchanges heat with the outside air to dissipate the heat to the surrounding air.

In some embodiments, the heat dissipation device 1 further includes a fan arranged opposite to the heat dissipating member 21. The fan can be used to accelerate flowing of the air, thereby enhancing the heat exchange effect between the heat dissipating member 21 and the air and improving the heat dissipation capability of the heat dissipation device 1.

In the illustrated embodiment, the heat absorbing member 10 is provided with a first accommodating chamber 11 and a mounting hole 12 in communication with the first accommodating chamber 11. The first accommodating chamber 11 is configured to accommodate a phase change working medium 60 such as water, ethanol, and more, and a valve 30 is mounted in the mounting hole 12. The valve 30 is adjustable between a first state and a second state. When the valve 30 is in the first state, the first accommodating chamber 11 is in a closed state. When the valve 30 is in the second state, the first accommodating chamber 11 is in an open state and the phase change working medium 60 can be injected into the first accommodating chamber 11, or the phase change working medium 60 in the first accommodating chamber 11 can be discharged. In other words, the valve 30 can be adjusted to communicate the first accommodating chamber 11 with the outside or turn off the communication of the first accommodating chamber 11 with the outside. Optionally, the heat absorbing member 10 has a plate-shaped configuration. The heat absorbing member 10 comprises a bottom wall configured for contacting with the heat source 70, a top wall spaced apart from and opposite to the bottom wall, and a side wall connected between the bottom wall and the top wall. The mounting hole 12 is defined in the side wall of the heat absorbing member 10.

When the heat dissipation device 1 is used, the first accommodating chamber 11 can be opened by adjusting the state of the valve 30, and the phase change working medium 60 can be injected into the first accommodating chamber 11 or discharge part of the phase change working medium 60 from the first accommodating chamber according to the actual heat dissipating requirement of the specific application. After the amount adjustment of the working medium 60 is completed, the first accommodating chamber 11 can be closed by the valve 30. Since the heat dissipation device 1 can adjust the amount of the phase change working medium 60 according to different heat dissipating requirements, the heat dissipation device 1 is applicable to various applications with different heat flux densities and different heat dissipating requirements, and can achieve a good heat dissipation effect by using different amount of working medium 60 in various applications.

Figure 4:
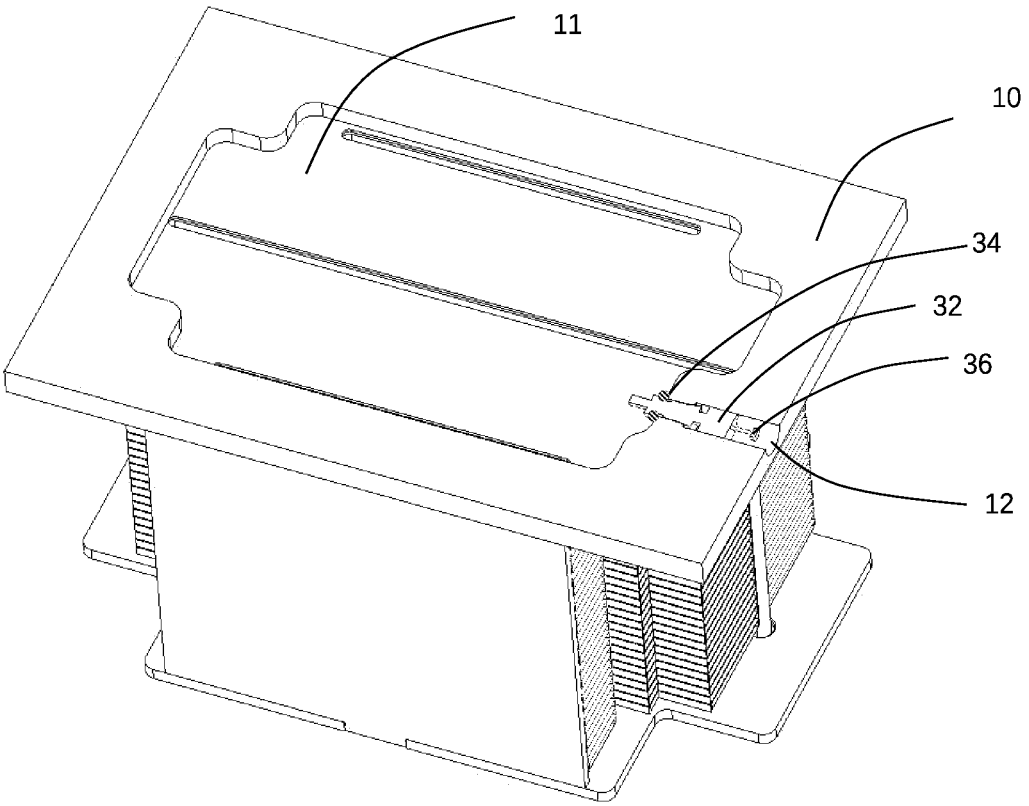
FIG. 4 illustrates the heat dissipation device viewed from another aspect for clearly showing the valve of the heat dissipation device.

Understandably, the type of the valve 30 is not limited. For example, the valve 30 may be a valve core, a rubber plug or the like that is detachably mounted in the mounting hole 12. When the valve 30 is located in the mounting hole 12 to make the first accommodating chamber 11 become a sealed space, the valve 30 is in the first state. When the valve 30 is removed from the mounting hole 12 to allow the first accommodating chamber 11 to communicate with the outside through the mounting hole 12, the valve 30 is in the second state. Alternatively, the valve 30 can be a liquid injection valve for example a quick connector which can be mounted in the mounting hole 12. Referring to FIG. 4, the liquid injection valve comprises a valve body 32 slidably mounted in the mounting hole 12 and a sealing ring 34. One end of the valve body 32 is inserted into the first accommodating chamber 11 and the sealing ring 34 is secured around the end of the valve stem 32 inserted into the first accommodating chamber 11. When the liquid injection valve is in the first state, the liquid injection valve makes the first accommodating chamber 1 become a sealed space by the sealing ring 34 which is sealedly in contact with the inner surface of the mounting hole 12. When the liquid injection valve is in the second state, the sealing ring 34 is moved away from the inner surface of the mounting hole 12 and not sealedly in contact with the inner surface of the mounting hole 12, thereby allowing the first accommodating chamber 11 to communicate with the outside. Thus, a liquid supply device (not shown) can be attached to the mounting hole 12 to communicate with the first accommodating chamber 11 such that the liquid supply device is capable of feeding phase change working medium 60 into the first accommodating chamber 11. Optionally, the liquid injection valve further comprises a rod 36 connected to the valve body 32. When the liquid supply device is attached to the mounting hole 12, the liquid supply device pushes the rod 36 to drive the valve body 32 with the sealing ring 34 to move, which results in the sealing ring 34 moving away from the mounting hole 12 and not sealedly in contact with the inner surface of the mounting hole 12. A return spring may be applied to return the valve body 32 and the sealing ring 34 back to the first state from the second state.

In some embodiments, the heat dissipation device 1 further includes a plurality of heat dissipating fins 22, mounted on the heat dissipating member 21. After absorbing heat, the phase change working medium 60 in the heat absorbing member 10 is heated and evaporated to form a high-temperature gas. After the high-temperature gas rises, it comes into contact with the heat dissipating member 21 and transfers the heat to the heat dissipating member 21, and thus the temperature of the high-temperature gas itself decreases and the gas is condensed into a liquid again and returns to the first accommodating chamber 11 under the action of gravity so that the heat absorbing member 10 can absorb heat from the heat source continuously. The heat of the heat dissipating member 21 is conducted to the heat dissipating fins 22, and the heat dissipating fins 22 are configured to exchange heat with the air around the fins 22 so that the heat is finally dissipated to the surrounding air. The arrangement of the heat dissipating fins 22 increases the contact area between the heat dissipation device 1 and the air, thereby enhancing the heat dissipation effect of the heat dissipation device 1.

The heat dissipating member 21 comprises one or multiple heat dissipating elements. The number of the heat dissipating elements is not limited. In this embodiment, three heat dissipating elements are provided. Optionally, the top wall of the heat absorbing member 10 defines one or multiple mounting slots, and the ends of the heat dissipating elements close to the first accommodating chamber 11 are secured in the mounting slots. The three heat dissipating elements are arranged in parallel and spaced from each other, and multiple heat dissipating fins 22 stacked in a direction away from the heat absorbing member 10 are connected between any two adjacent heat dissipating elements or connected between adjacent heat dissipating element and side plate 50. By providing multiple heat dissipating elements and multiple heat dissipating fins 22, the heat dissipation effect of the heat dissipation device 1 is enhanced.

The type of the heat dissipating fins 22 is not limited. For example, the heat dissipating fins 22 may be folded fins which are folded from a continuous thin plate or snap-fit fins which are formed by independent/separate fins connected together via snap-fit means, or a combination of folded fins or snap-fit fins.

Figure 3:
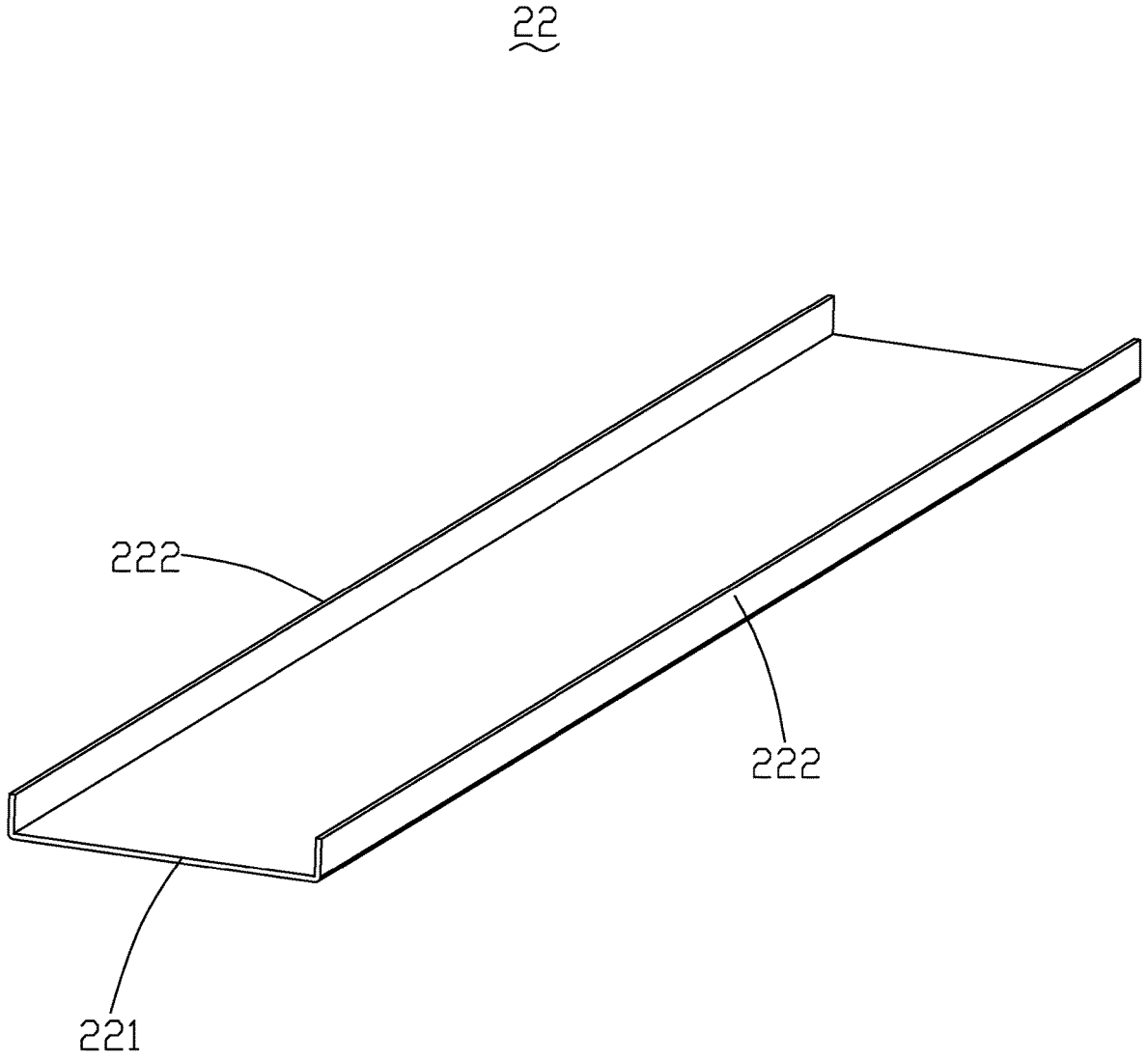
FIG. 3 is a schematic structural diagram of a heat dissipating fin shown in FIG. 2.

Referring to FIG. 3, in the illustrated embodiment, each heat dissipating fin 22 includes a base plate 221 and two fixing plates 222 extending from opposite side edges of the base plate 221. The two fixing plates 222 and the base plate 221 are preferably but not limited to being integrally formed. The heat dissipating fins 22 are connected to the heat dissipating members 21 by the fixing plates 222, and the base plates 221 of every two adjacent heat dissipating fins 22 one above the other are spaced apart from each other. By providing the fixing plates 222, the contact area between the heat dissipating fins 22 and the heat dissipating members 21 can be increased, thereby enhancing the heat conduction efficiency between the heat dissipating fins 22 and the heat dissipating members 21. Every two adjacent base plates 221 being spaced apart from each other can increase the contact area between the heat dissipating fins 22 and the air, thereby enhancing the heat dissipation effect. Furthermore, slots are formed between adjacent fins 22, which allows airflow generated by the fan to pass through the slots to thereby enhance the heat dissipation effect of the heat dissipating fins 22. Optionally, the fixing plates 222 of every fin 22 has the same width and the distance between two adjacent base plates 221 is equal to the width of the fixing plates 222.

In some embodiments, the heat dissipation device 1 further includes a cover plate 40 opposite to and spaced from the heat absorbing member 10 and two side plates 50 opposite to and spaced from each other. The cover plate 40 is fixed on a side of the heat dissipating member 21 away from the heat absorbing member 10. The two side plates 50 are connected between the cover plate 40 and the heat absorbing member 10. The heat dissipating members 21 are arranged between the two side plates 50, and the heat dissipating fins 22 are arranged between the side plates 50 and the adjacent heat dissipating members 21. The arrangement of the side plates 50 and the cover plate 40 can protect the heat dissipating fins 22 and the heat dissipating members 21.

In some embodiments, the cover plate 40 and the side plates 50 are also made of a material with good thermal conductivity, so the heat of the high-temperature gas generated by the phase change working medium 60 can also be dissipated into the surrounding air through the cover plate 40 and the side plates 50, thus further enhancing the heat dissipation effect of the heat dissipation device 1.

In the illustrated embodiment, a gas-liquid flow passage 211 is formed inside the heat dissipating member 21, and the gas-liquid flow passage 211 extends from the heat absorbing member 10 toward the cover plate 40. One end of the heat dissipating member 21 extends into the first accommodating chamber 11 and is provided with a guide channel 212 which communicates the first accommodating chamber 11 with the gas-liquid flow passage 211. The guide channel 212 is wider than the gas-liquid flow passage 211. After the working medium 60 in the first accommodating chamber 11 absorbs the heat of the heat absorbing member 10 to form vaporized working medium 60 with high temperature, the vaporized working medium 60 can enter the gas-liquid flow passage 211 through the guide channel 212 and come into full contact with the heat dissipating member 21 to achieve a good heat exchange effect between the heat dissipating member 21 and the vaporized working medium 60. The heat of the heat dissipating member 21 is dissipated to air via the heat dissipating fins 22. During the process of heat exchange between the vaporized working medium 60 and the heat dissipating member 21, the temperature of the vaporized working medium 60 decreases and the vaporized working medium 60 is condensed into liquid which returns into the first accommodating chamber 11 along an inner wall of the gas-liquid flow passage 211. Optionally, the inner wall of the gas-liquid flow passage 211 is provided with a capillary structure to form a liquid path so that the liquid can return back to the first accommodating chamber 11 through the liquid path under capillary action.

It can be understood that the number of gas-liquid flow passages 211 is not limited, and may be one or multiple.

In other embodiments, the heat dissipating member 21 may also be configured as a solid metal plate; in other words, no gas-liquid flow passage 211 is provided within the heat dissipating member 21, and the heat is exchanged directly between the end of the heat dissipating member 21 extended into the first accommodating cavity and the vaporized working medium 60.

In some embodiments, a second accommodating chamber in fluid communication with the gas-liquid flow passage 211 may further be arranged in the cover plate 40, so that the vaporized working medium 60 can not only exchange heat with the heat dissipating members 21, but also exchange heat with the cover plate 40, thus further enhancing the heat dissipation effect of the heat dissipation device 1.

In some embodiments, a side of the cover plate 40 facing the heat dissipating members 21 is provided with positioning protrusions 41, and the heat dissipating members 21 are correspondingly provided with positioning grooves 213 for receiving the positioning protrusions 41, so as to facilitate the assembly of the heat dissipation device 1. It can be understood that the number of the positioning grooves 213 is not limited, and one positioning groove 213 may be provided on every heat dissipating member 21, or the positioning grooves 213 may be provided on one or more of the heat dissipating members 21.

According to the heat dissipation device of the disclosure, the first accommodating chamber can be opened or closed by operating the valve, and an operator can inject the phase change working medium 60 into the first accommodating chamber or discharge part of the phase change working medium 60 from the first accommodating chamber according to different requirements, so as to adjust the amount of the phase change working medium 60 in the first accommodating chamber. Therefore, the heat dissipation device is suitable for various applications of different heat flux densities and different heat dissipating requirements by adjusting the amount of the phase change working medium 60 within the heat dissipation device, and is capable of achieving good heat dissipation effects in the various applications.

The above-mentioned embodiments are only the preferred embodiments of the disclosure and should not be construed as limiting the scope of the disclosure. Any insubstantial changes and substitutions made by those skilled in the art on the basis of the disclosure fall within the scope of the disclosure.

What is claimed is:

1. A heat dissipation device, comprising:

a heat absorbing member configured to absorb heat from a heat source, the heat absorbing member being provided with a first accommodating chamber for accommodating a phase change working medium and a mounting hole in communication with the first accommodating chamber;

a heat dissipating member connected to the heat absorbing member;

a cover plate arranged at an end of the heat dissipating member away from the heat absorbing member;

heat dissipating fins connected to the heat dissipating member and stacked between the heat absorbing member and the cover plate with an interval such that the heat dissipating member is capable of transferring heat from the heat absorbing member to the heat dissipating fins, the fins being parallel to the cover plate; and a valve installed in the mounting hole of the heat absorbing member, the valve being adjustable between a first state and a second state to cause the first accommodating chamber to change between a closed state and an open state;

wherein when the first accommodating chamber is in the open state, the first accommodating chamber is in fluid communication with outside the first accommodating chamber so that the phase change working medium can be injected into or discharged from the first accommodating chamber, wherein a passage in fluid communication with the first accommodating chamber is provided inside the heat dissipating member;

wherein an end of the heat dissipating member close to the first accommodating chamber is provided with a guide channel which is in fluid communication with the first accommodating chamber and the passage; and wherein the end of the heat dissipating member close to the first accommodating chamber has a reduced thickness such that an inner size of the passage at the guide channel is greater than that of the passage at other portions.

2. The heat dissipation device according to claim 1, wherein a second accommodating chamber in fluid communication with the passage is formed inside the cover plate.

3. The heat dissipation device according to claim 1, wherein the heat dissipating member comprises multiple spaced heat dissipating elements, a side of the cover plate facing the heat dissipating elements is provided with positioning protrusions, and the heat dissipating elements are correspondingly provided with positioning grooves for receiving the positioning protrusions respectively and multiple passages in fluid communication with the first accommodating chamber, each of the positioning grooves being in fluid communication with a corresponding one of the passages.

4. The heat dissipation device according to claim 1, wherein two side plates are arranged on opposite sides of the heat absorbing member respectively, the heat dissipating member comprises multiple spaced heat dissipating elements arranged between and spaced from the two side plates, and the heat dissipating fins are respectively arranged between the heat dissipating elements or between one of the heat dissipating elements and a corresponding one of the side plates.

5. The heat dissipation device according to claim 4, wherein each of the fins comprises a base plate and a pair of fixing plates extending from opposite side edges of the base plate, the fixing plates being secured to the heat dissipating elements or the side plates.

6. The heat dissipation device according to claim 5, wherein the heat dissipating element has a plate-shaped configuration, the fixing plates are parallel to the heat dissipating elements, and the base plate is perpendicular to the fixing plates and the heat dissipating elements.

7. The heat dissipation device according to claim 5, wherein the fixing plates of each fin has a same width, and a distance between two adjacent base plates is equal to the width of the fixing plates.

8. The heat dissipation device according to claim 1, wherein the heat dissipating member is configured as a solid metal plate.

9. The heat dissipation device according to claim 1, wherein when the first accommodating chamber is in the closed state, the first accommodating chamber is sealed and isolated from outside the first accommodating chamber.

10. The heat dissipation device according to claim 1, wherein the valve is a plug which is detachably mounted in the mounting hole.

11. The heat dissipation device according to claim 1, wherein the heat absorbing member comprises a bottom wall configured for contacting with the heat source, a top wall spaced apart from and opposite to the bottom wall, and a side wall connected between the bottom wall and the top wall;

the first accommodating chamber is formed between the top wall, the bottom wall and the side wall; and the mounting hole is defined in the side wall.

12. The heat dissipation device according to claim 11, wherein the top wall defines a mounting slot, and an end of the heat dissipating member close to the first accommodating chamber is secured in the mounting slot.

13. The heat dissipation device according to claim 1, wherein the valve is a liquid injection valve.

14. The heat dissipation device according to claim 13, wherein the liquid injection valve comprises a valve body slidably mounted in the mounting hole, and a sealing ring mounted around the valve body and configured to seal the first accommodating chamber in the closed state.

15. The heat dissipation device according to claim 3, wherein two side plates are arranged on opposite sides of the heat absorbing member respectively, the heat dissipating elements are arranged between and spaced from the two side plates, the heat dissipating fins are respectively arranged between the heat dissipating elements or between one of the heat dissipating elements and a corresponding one of the side plates, and the two side plates are connected between the cover plate and the heat absorbing member.

16. The heat dissipation device according to claim 1, wherein the heat absorbing member is provided with a locking slot at a side thereof close to the heat dissipating member, and a pair of flanges extending from the side thereof into the first accommodating chamber, the locking slot being formed between the flanges, the end of the heat dissipating member with the reduced thickness entering into the first accommodating chamber and being fixed in the locking slot.

17. The heat dissipation device according to claim 16, wherein the first accommodating chamber comprises a bottom surface facing the flanges, and the end of the heat dissipating member close to the first accommodating chamber is spaced from the bottom surface of the first accommodating chamber.

18. A heat dissipation device, comprising:

a heat absorbing member configured to absorb heat from a heat source, the heat absorbing member being provided with a first accommodating chamber for accommodating a phase change working medium and a mounting hole in communication with the first accommodating chamber;

a heat dissipating member connected to the heat absorbing member;

a cover plate arranged at an end of the heat dissipating member away from the heat absorbing member;

heat dissipating fins connected to the heat dissipating member and stacked between the heat absorbing member and the cover plate with an interval such that the heat dissipating member is capable of transferring heat from the heat absorbing member to the heat dissipating fins, the fins being parallel to the cover plate; and a valve installed in the mounting hole of the heat absorbing member, the valve being adjustable between a first state and a second state to cause the first accommodating chamber to change between a closed state and an open state;

wherein when the first accommodating chamber is in the open state, the first accommodating chamber is in fluid communication with outside the first accommodating chamber so that the phase change working medium can be injected into or discharged from the first accommodating chamber;

wherein the heat dissipating member comprises multiple spaced heat dissipating elements, a side of the cover plate facing the heat dissipating elements is provided with positioning protrusions, and the heat dissipating elements are correspondingly provided with positioning grooves for receiving the positioning protrusions respectively and passages in fluid communication with the first accommodating chamber, each of the positioning grooves being in fluid communication with a corresponding one of the passages; and wherein two side plates are arranged on opposite sides of the heat absorbing member respectively, the heat dissipating elements are arranged between and spaced from the two side plates, the heat dissipating fins are respectively arranged between the heat dissipating elements or between one of the heat dissipating elements and a corresponding one of the side plates, and the two side plates are connected between the cover plate and the heat absorbing, and wherein an end of the heat dissipating member close to the first accommodating chamber is provided with a guide channel which is in fluid communication with the first accommodating chamber and the passage; and wherein the end of the heat dissipating member close to the first accommodating chamber has a reduced thickness such that an inner size of the passage at the guide channel is greater than that of the passage at other portions.

* * * * *